US005653268A

United States Patent [19]

Burkert

[11] Patent Number: 5,653,268

[45] Date of Patent: Aug. 5, 1997

[54] MODULATOR MECHANISM FOR A ROTARY DOBBY IN A LOOM

[75] Inventor: Martin Burkert, Bayreuth, Germany

[73] Assignee: Stäubli GmbH, Germany

[21] Appl. No.: 585,736

[22] Filed: Jan. 16, 1996

[30] Foreign Application Priority Data

Jan. 16, 1995 [DE] Germany ..... 295 00 594.7
Oct. 12, 1995 [DE] Germany ..... 195 38 018.5

[51] Int. Cl.[6] ..... D03C 1/02; D03C 1/14

[52] U.S. Cl. ..... 139/79; 139/76; 74/52; 74/105

[58] Field of Search ..... 139/79, 76; 74/105, 74/52, 84 R

[56] References Cited

U.S. PATENT DOCUMENTS 3,407,678 10/1968 Steinke .
4,179,942 12/1979 Matthews ..... 74/52
4,534,385 8/1985 Froment et al. ..... 139/79
4,924,915 5/1990 Vinciguerra .
4,984,607 1/1991 Beyaert ..... 139/79
5,107,901 4/1992 Pages et al. ..... 139/76

FOREIGN PATENT DOCUMENTS 0 035 954 9/1981 European Pat. Off. .

*Primary Examiner*—Andy Falik

[57] ABSTRACT

A modulator mechanism for a rotary dobby, the input side of the modulator mechanism being connected to a drive which rotates at an essentially constant angular velocity and the output side thereof providing an output which is applied to a main shaft controlling heald shafts and which is temporally modulated inch a way that a delay of the movements of the heald shafts their maximum displacement positions is caused. To permit a sufficiently large shed rest angle for aft insertion in the case of fabrics having a very large width, a substantially enlarged shed rest angle is provided by a rotatable cam body, which is connected to the drive, and by at least one cam body follower in the form of an articulated lever, which, when the cam body rotates, carries out an oscillating pivoting movement modulated in accordance with the cam shape of the cam body, the pivoting movement being transmitted to the main shaft.

12 Claims, 4 Drawing Sheets

MODULATOR MECHANISM FOR A ROTARY DOBBY IN A LOOM

BACKGROUND OF THE INVENTION

The present invention relates to a modulator mechanism for a rotary dobby, the input side of said modulator mechanism being connected to a drive means which is capable of rotating and the output side thereof providing an output which is applied to a main shaft controlling heald shafts and which is temporally modulated relative to the rotary movement of the drive means in such a way that a delay of the movements of the heald shafts at their maximum displacement positions is caused.

Such modulator mechanisms for rotary dobbies are known e.g. from the U.S. Pat. 5,107,901. Rotary dobbies including a drive means, which rotates at an essentially constant angular velocity, are provided with a modulator mechanism so as to drive a main shaft continuously in a certain direction at a modulated rotary speed. The rotary motion of the main shaft is converted into a linear movement of a heald frame via a crank and a connecting rod articulated on said crank, the movement of the heald frame at its two maximum displacement positions being delayed due to the modulated rotary motion of the main shaft. At each of these maximum displacement positions, a shed for weft insertion is formed, a longer shed rest being achieved due to the irregular movement of the main shaft.

In the above-mentioned prior art, a cycloidal mechanism and a disc cam mechanism with stationary cam discs and with a rotating roller lever are shown, which convert a rotary motion taking place at a constant angular velocity into a rotary motion taking place in a uniform direction at a variable angular velocity and points of rest for producing periods of rest at the dead centers. Due to the maintenance of a rotary motion in a uniform direction at the output of the modulator mechanism, the periods of rest which can be achieved at the dead points as well as the shed rest angles which can be obtained are limited by the structural design of the modulator mechanism in question.

For various weaving techniques, e.g. for the production of fabrics for technical use, or for fabrics having a particularly large width, large shed rest angles and long periods of rest at the dead centers of the crank arm of a rotary dobby are necessary so as to open the shed for a period of time which is sufficiently long for weft insertion. The large shed rest angles required in this connection cannot be achieved by the modulator mechanisms known according to the prior art.

SUMMARY OF THE INVENTION

Hence, it is the object of the present invention to provide a modulator mechanism for a rotary dobby in a loom by means of which larger shed rest angles can be realized.

In accordance with the present invention, this object is achieved by a modulator mechanism for a rotary dobby of the type mentioned at the beginning, comprising a rotatable cam body means, which is connected to said drive means, and at least one cam body follower in the form of an articulated lever, which, when said cam body means rotates, carries out an oscillating pivoting movement modulated in accordance with the cam shape of said cam body means, said pivoting movement being adapted to be transmitted to the main shaft. In accordance with the present invention, the rotary motion which has a constant angular velocity and which is applied to the input side is converted into a modulated oscillating pivoting movement, which may take place over a comparatively small angular area of the cam body means so that comparatively long periods of rest can be achieved at the dead centers of the pivoting movement. The use of a cam body means whose cam shape is transmitted to a cam body follower permits a simple and individual modulation of the drive movement.

In accordance with a preferred embodiment, the cam body means comprises a rigidly interconnected, complementary pair of cam discs, the cam body follower having the form of a lever including two legs and the legs of said lever following a respective one of the two cam discs for restrictedly guiding the lever. In view of the restricted guidance, the position of the cam body follower is unequivocally determined by the rotary position of the cam body means, without any additional means, such as a spring preload against the cam body means, being necessary for guiding the cam body follower.

In accordance with an additional advantageous embodiment, the cam body means comprises globoidal cams or conical eccentric cams. This has the effect that the axes of rotation of the cam body means and of the cam body follower cross or intersect. The spatial position of a drive shaft connected to the cam body means can thus be adapted to the spatial position of the output shaft of the loom in such a way that an economy-priced, heavy-duty drive element, such as a toothed belt, can be used.

In accordance with an advantageous embodiment, a gear unit having a predetermined transmission ratio is provided for transmitting the oscillating pivoting movement of the lever to the main shaft. The gear unit comprises, in a particularly advantageous manner, a planetary gearing whose sun gear lies on an axle extending through the point of articulation of the lever of the cam body follower and whose respective planetary gear is rotatably secured to the lever. The lever may also have secured thereto the internal gear instead of the planetary gear. The use of a planetary gearing permits to achieve a desired transmission ratio on the on hand and a space-saving and compact structural design on the other.

In accordance with a further advantageous embodiment, a transmission ratio is provided in the gear unit which is of such a nature that it results in an oscillation of the main shaft through a rotary angle of essentially 180°. This measure provides the advantage that the retracting force, which is applied during the period of maximum-amplitude displacement of the heald shafts, will not result in any torque acting on the modulator mechanism. It follows that the cam body follower is not acted upon by any additional reactive force at the shed rest angles, whereby further wear will be avoided. Furthermore, a modulator mechanism having an adequate transmission ratio for causing an oscillation of the main shaft through a rotary angle of essentially 180° is compatible with hitherto used mechanisms in rotary dobbies so that existing modulator mechanisms can be replaced by the mechanism according to the present invention without major technical modifications being necessary.

In accordance with a further advantageous embodiment, the modulator mechanism is provided with an additional rotating device, which is independent of the drive means and which is used for rotating the main shaft. With the aid of said additional rotating device, an integrated so-called pick-finder mechanism is realized by means of which the main shaft can be driven and a shed can be formed even if the loom and, consequently, the dobby are standing still. This additional rotating device, which permits shedding even if the loom is standing still, provides the advantage that the fabric can, for example, be checked or corrected more easily.

In accordance with an advantageous embodiment, the modulator mechanism provided with an additional rotating device, which is independent of the drive means, comprises a planetary gearing for transmitting the oscillating pivoting movement of the lever to the main shaft, said planetary gearing comprising a sun gear, which is connected to the main shaft, and one or several planetary gears, which engage between the sun gear and an internal gear, the planetary gear or the planetary gears being each rotatably secured to said lever, and said internal gear being rotatably supported and adapted to be driven by said additional rotating device. Alternatively to this embodiment, an advantageous further development of the modulator mechanism provided with said additional rotating device includes a planetary gearing of the above-mentioned type which, however, shows the feature that the internal gear is rigidly connected to the lever, the planetary gears being secured to an additional rotatable holder, and said rotatable holder being adapted to be driven by said additional rotating device. The use of a planetary gearing permits a compact structural design of the modulator mechanism with the aid of which the integrated pick-finder mechanism can be realized in a comparatively simple manner.

The additional rotating device can comprise e.g. an electric motor, a hydraulic motor or a pneumatic motor.

The modulator mechanism constructed as a planetary gearing includes, in accordance with an advantageous embodiment, a locking device which is adapted to be used for fixing, when the drive originating from the loom is in operation, the internal gear, which is adapted to be driven by the additional rotating device, or the rotatable holder for the planetary gears.

In accordance with an advantageous further development, this locking device comprises a pin or a wedge, which is adapted to be brought into locking engagement with a complementary recess formed in said internal gear or in said rotatable holder. The locking device can also be provided in the form of a toothed clutch or in the form of a friction brake.

Further advantageous embodiments are disclosed by the subclaims.

BRIEF DESCRIPTION OF THE DRAWINGS

In the following, the invention will be explained and described in detail with reference to embodiments shown in the drawings, in which.

DETAILED DESCRIPTION OF THE PREFERRED EMBODIMENTS

Figure 1:
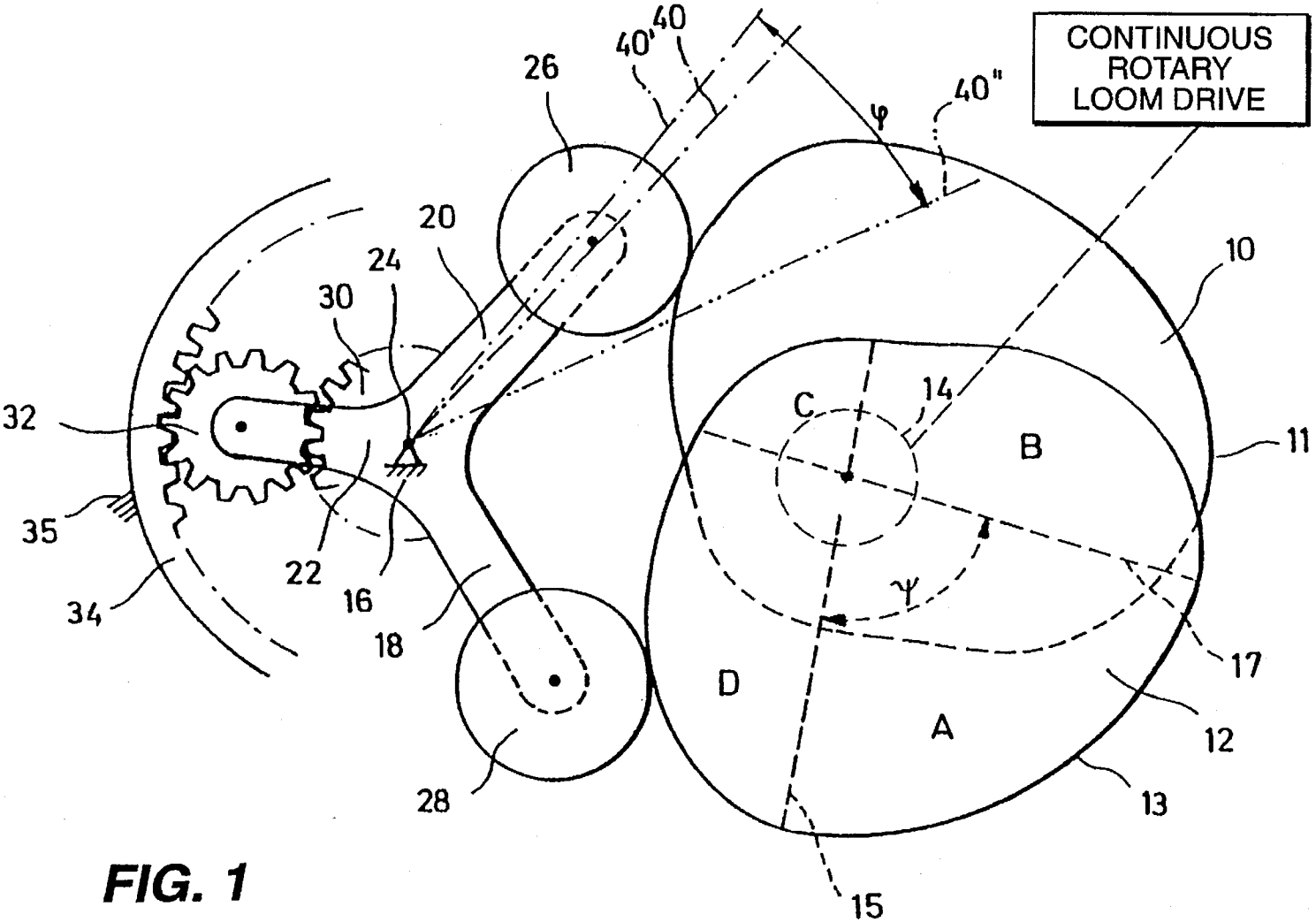
FIG. 1 shows a schematic representation of a preferred embodiment of the modulator mechanism according to the present invention.

An embodiment of the modulator mechanism according to the present invention, which is schematically shown in FIG. 1, comprises a cam body means including a pair of cam discs 10 and 12, which are complementary to each other and which are rigidly interconnected. The cam discs 10 and 12, which are adapted to be rotated about an axle 14 arranged at right angles to said discs, are connected to a drive (not shown) originating from a loom. A cam body follower comprising a roller lever 16 is located opposite the cam body means, said roller lever 16 being fixed to a rotatable axle 24, which is parallel to the axle 14, and including two legs 18 and 20, which face the respective cam discs 10 and 12 and which each have attached thereto a roller 28 and 26, said rollers 28 and 26 being adapted to roll on the circumferential surfaces 11 and 13 of the two complementary cam discs. Instead of rollers, there may also be provided suitable sliding members. The roller lever 16 is provided with a third lever arm 22 having rotatably attached thereto a gear 32. Said gear defines a planetary gear 32 which is in mesh with a stationary internal gear 34 on the one hand and with a sun gear 30 on the other. It would also be possible that the planetary gear or planetary gears are arranged such that they define stationary, rotatable gears and that the internal gear 34 is secured to the lever such that it is adapted to be pivoted together therewith about a common axle. The planetary gear 32 engages the sun gear 30 on the side located opposite the internal gear, said sun gear 30 being independent of the roller lever 16, but its axis of rotation being coincident with the articulation axle 24 of the roller lever 16. The sun gear 30 is connected to the drive means of the dobby.

Instead of a complementary pair of cam discs, the cam body means may also be provided with three-dimensional cam bodies, e.g. in the form of globoidal cams or conical eccentric cams. This would have the effect that the axes of rotation of the cam body means and of the cam body follower could cross or intersect. The spatial position of a drive shaft connected to the cam body means could thus be adapted to the spatial position of the output shaft of the loom in such a way that an economy-priced, heavy-duty drive element, such as a toothed belt, could be used.

The complementary cam discs 10 and 12, each of which is in rolling contact with one of the rollers 26 and 28 of the roller lever, have, with regard to the rotating axle 14, a shape of such a nature that each of the two rollers 26 and 28 will abut on the circumferential surface of the respective cam disc associated therewith, independently of the rotary position of the cam disc means. This has the effect that a restricted guide means is defined, in the case of which each rotary angle of the cam body means has associated therewith an exactly defined angular position of the roller lever. In an angular region $\psi$ marked by the two broken lines, each of the cam discs has an area A in which the periphery extends at a constant radial distance from the rotating axle 14. An angular regional $\psi$ in which the cam disc has an area C of small constant radial distance is located opposite said area A of large constant radial distance, said angular regions having the same size and being displaced by 180°. In the areas B and D between said sections A and C of constant radial distance, the radial distance of the path of the periphery relative to the rotating axle 14 ascends continuously or descends continuously.

When the modulator mechanism according to the present invention is in operation, the cam disc means 10, 12, which is connected to the drive originating from the loom, is rotated about the axle 14 at a constant angular velocity. The rollers 26 and 28 of the roller lever 16, which roll on the respective circumferential surfaces 11 and 13, are restrictedly guided due to the appropriate structural design of the complementary cam discs. When a roller, e.g. roller 28, rolls on the circumference in an area D of the associated cam disc 12, in which a change in the radial distance between the circumferential surface and the rotating axle 14 occurs, a rotation of the cam disc means about the axle 14 will cause a displacement of the roller lever 16. For example, when the cam disc means is rotated clockwise, the roller lever 16 will be displaced downwards, starting from the position shown in FIG. 1, until, at a position of maximum displacement, the lever 20 will be located such that it is oriented along the double dot-and-dash line 40Δ, when the roller 28 reaches the area A of the cam disc 12. The position of the roller lever 16 will not change while rollers 28 and 26 roll through the area A of constant radial distance with regard to the axle 14. When the cam disc means continues to rotate clockwise, the roller 28 will roll along the circumference of sector B and the roller lever 16 will move upwards until it reaches a maximum position, marked by the double dot-and-dash line 40', when said roller 28 has reached sector C of cam disc 12. The roller lever 16 remains at this position of maximum upper displacement while the roller 28 rolls along the circumference of said sector C. When the rotation is continued, said roller 28 will again roll along said sector D of increasing radial distance, whereby said roller lever 16 will be displaced downwards.

The resultant oscillating pivoting movement of the roller lever 16 is transmitted to the sun gear 30 via the planetary gear 32 which is in mesh with the internal gear 34, the pivot angle produced by the roller lever being enlarged in accordance with the transmission ratio due to the transmission of the planetary gearing. The transmission ratio of the planetary gearing is preferably chosen such that the sun gear 30 rotates through an angle of 180°.

It is also possible to provide and arrangement in which the roller lever 16 is connected to three planetary gears. In this case, the roller lever need not be articulated on the axle 24. It will inevitably be pivoted about said axle. The planetary gears, which are carried along when the roller lever is being pivoted and which are caused to rotate due to their engagement with the internal gear, would again drive a sun gear with the transmission ratio chosen.

In addition to the embodiment shown in FIG. 1, it would also be possible to use, instead of the planetary gearing, a conventional spur gearing or toothed belt transmission, which are known per se, so as to achieve the desired transmission ratio for driving the main shaft.

Figure 2:
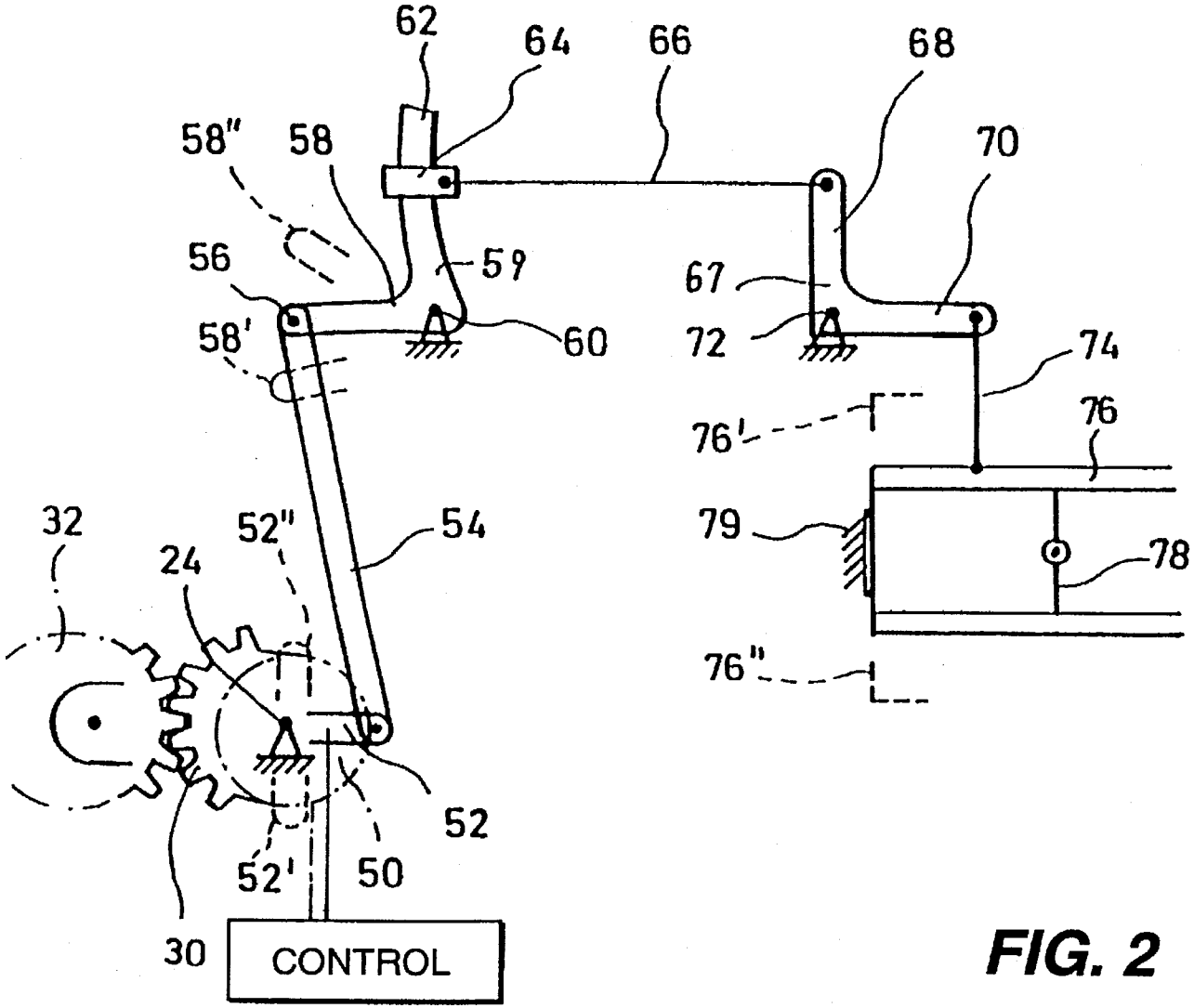
FIG. 2 shows a schematic representation of an example which shows how the output power of the mechanism is transmitted to the weaving frame.

FIG. 2 shows an example of a rod transmission mechanism used for converting the modulated oscillating movement of a output shaft into a linear movement of a heald frame 76 as well as for the purpose of transmission. A output shaft 50, which may be formed integrally with the sun gear 30, is provided with a fixed radial crank 52 and a connecting rod 54 articulated on said crank. The maximum-amplitude positions at which the crank 52 occupies exactly its dead centre positions are shown by reference numerals 52' and 52". Instead of the crank 52, which is schematically shown in FIG. 2, also other eccentric units would be suitable for converting the modulated oscillating pivoting movement of the main shaft 50 into a linear movement.

The connecting rod 54 is articulated on a two-leg lever 59, which comprises the legs 58 and 62 and which is articulated on an axle 60. Reference numerals 58' and 58" show the maximum-amplitude positions for the displacement of leg 58. The leg 62 has articulated thereon a transmission rod 66 e.g. via a displaceable connection 64, the other end of said transmission rod 66 being articulated on a two-leg, essentially rectangular second lever 67, which is adapted to be rotated about an axle 72. The leg 70 of said lever 67 has articulated thereon an additional transmission rod 74, which is articulated on the heald frame 76, said heald frame 76 being guided such that it is displaceable in the direction of movement of the leg 70, as is schematically shown by reference numeral 79. A heald 78 is provided in the heald frame 76 so as to effect shedding in the way in which this is normally done in the field of weaving technology.

As can be seen from FIG. 2, a rotation of the main shaft to the upper maximum-amplitude position 52" results in a displacement of the first lever to position 58", which will result in a corresponding displacement of the second lever 67, and this displacement will, in turn, be transmitted to the heald frame 76, which is adapted to be displaced in the direction of displacement of the leg 70 and which will then be moved to its lower maximum displacement position 76". An orientation of the main shaft in the case of which the crank 52 occupies its lower maximum-amplitude position 52' has, vice versa, the effect that the heald frame 76 will occupy the upper maximum displacement position indicated by reference numeral 76'.

Due to the above-described structural design of the cam discs 10 and 12, in the case of which the radial distance between the circumferential surface and the rotating axle 14 remains constant throughout comparatively large angular areas A and C, a standstill of the shed is achieved in the maximum displacement positions, which coincide with the dead centers of the crank 52, although the modulator mechanism is still driven at a constant angular velocity. In view of the fact that, especially at the maximum displacement positions of the heald frame at which restoring forces, which are transmitted to the crank 52 via the rod linkage, act on said heald frame, the crank 52 and the connecting rod 54 articulated thereon are located at one of the dead centers, these restoring forces will not be transmitted to the modulator mechanism so that, at said maximum displacement positions, the rollers 26 and 28 can roll on the circumferences of the respective cam discs 1D and 12 without any additional application of force originating from the displacement of the heald frame 76.

Figure 3:
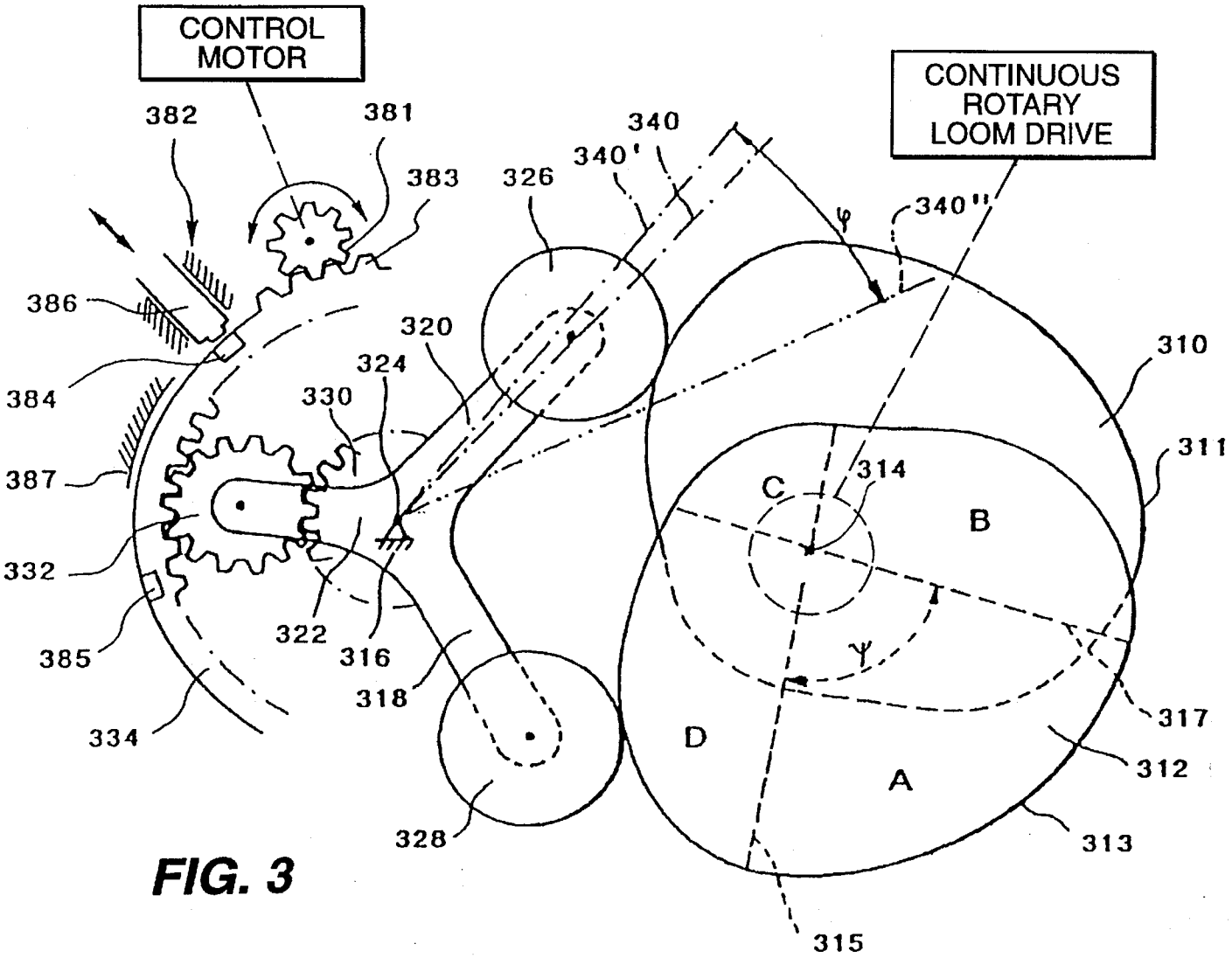
FIG. 3 shows a schematic representation of another preferred embodiment of the modulator mechanism according to the present invention provided with an additional rotating device which is independent of the drive means.

FIG. 3 shows an embodiment, which is additionally provided with a rotating device for rotating the main shaft, said rotating device being independent of the drive means. In FIG. 3, the parts which are equal or similar to the parts shown in FIG. 1 are designated by the same reference numerals which have, however, added thereto 300. As in the case of the example according to FIG. 1, the modulator mechanism according to FIG. 3 is provided with a planetary gearing for transmitting the pivoting movement of the lever 316 to the sun gear 330. Deviating from the embodiment according to FIG. 1, the embodiment according to FIG. 3 does not show the feature that the internal gear 334 is arranged such that it is secured against rotation relative to the housing, said internal gear 334 being, however, arranged such that it is adapted to be rotated about a rotating axle 324 extending through the center of rotation of the sun gear 330. The internal gear 334 is additionally provided with external teeth 383 which are in mesh with a gear 381 of said additional rotating device. Said gear 381 of the additional rotating device is connected to a drive means, which may be an electric motor, a hydraulic motor, a pneumatic motor or any other suitable motor. This motor is adapted to be controlled in a suitable manner by mechanical means or by electronic means. The control of the motor of the additional rotating device is independent of the drive means of the loom through which the cam bodies 310 and 312 are driven.

Instead of the additional external teeth, which are shown by way of example in the drawing of FIG. 3 on the outer circumference of the internal gear 334, said gear 381 may also be in mesh with the internal teeth of the internal gear 334 together with the planetary gear or the planetary gears 332.

Instead of the gear 381, any other suitable device for driving the rotatable internal gear 334 may be provided. Examples of other devices which are suitable for effecting the drive include a traction-means transmission, such as a chain, belt or rope drive, and a belt-wrap transmission, respectively.

In FIG. 3, a locking device 382 is additionally provided by means of which the internal gear can be fixed. In the example shown, the locking device 382 comprises a radially displaceable pin 386, which is adapted to be inserted into one or several complementary recesses 384 or 385 of the internal gear 334. The recesses 384, 385 provided in said internal gear may, for example, be arranged at such a distance from each other that the movement of said internal gear by a rotary angle which is equal to the distance between said two recesses corresponds to a rotation of the sun gear by 180° and, consequently, to one cycle of the dobby or to one pick. Instead of the shape shown in FIG. 3, the pin may also be wedge-shaped or conical, said shapes having the advantage that the internal gear 334 will be locked in a self-searching and backlash-free mode of locking. The locking devices can also be axially displaceable. In addition to or alternatively to the locking device 382 in the form of a radially displaceable pin, a friction brake 387 can be provided for decelerating the internal gear and for securing it in position. The internal gear 334 can also be locked via the gear 381 engaging the teeth 383 on said internal gear 334 or via an additional toothed clutch (not shown). The toothed clutch can, optionally, be provided with so-called finder teeth, which can only snap into place at specific angular positions. Locking can also be effected with the aid of an electric brake, e.g. of a servo motor with position control. By locking the internal gear 334 with the aid of the above-mentioned locking means in the form of the engaging pin 386, the friction brake 387, a toothed clutch or an electric brake, said internal gear 334 can be fixed relative to the housing of the modulator mechanism.

In the embodiment according to FIG. 3, a drive of the dobby can be effected by the additionally provided rotating device, if the drive originating from the loom and driving the cam discs 310 and 312 stands still. In this case, the rollers abutting on the cams 311 and 313 of the cam discs 310 and 312 are secured in position in an essentially backlash-free manner so that the lever 316 is fixed. For driving the internal gear 334, the locking engagement caused by means of the locking device 382 is now released by moving either the friction brake 387 or the pin 386 radially outwards, and the gear 381 is driven by driving the motor of the additional rotating device, said gear 381 engaging the teeth 383 on the internal gear 334 and rotating said internal gear. The planetary gear 332, which is rotatably attached to the arm 322 of the lever 316 held in place when the drive originating from the loom is standing still, is also caused to rotate due to the rotation of the internal gear 334 and, while rotating, it drives the sun gear 330. Via the sun gear 330, which is connected to the main shaft 350, the heald frame can now be moved in the manner described with regard to FIG. 2. The dobby can thus be moved through an arbitrary number of cycles and picks, respectively, when the loom is standing still. At the end of the downtime of the loom, the internal gear 334 will be locked again.

If necessary, the additional rotating device can also be operated when the loom is active and when the drive means, which causes the cam discs 10 and 12 to rotate, rotates. When the additional rotating device, which is independent of the drive means, is controlled in a suitable manner, it would e.g. be possible to additionally extend the dead center position of the main shaft beyond the degree provided by the shape of the cam discs 10 and 12.

Figure 4:
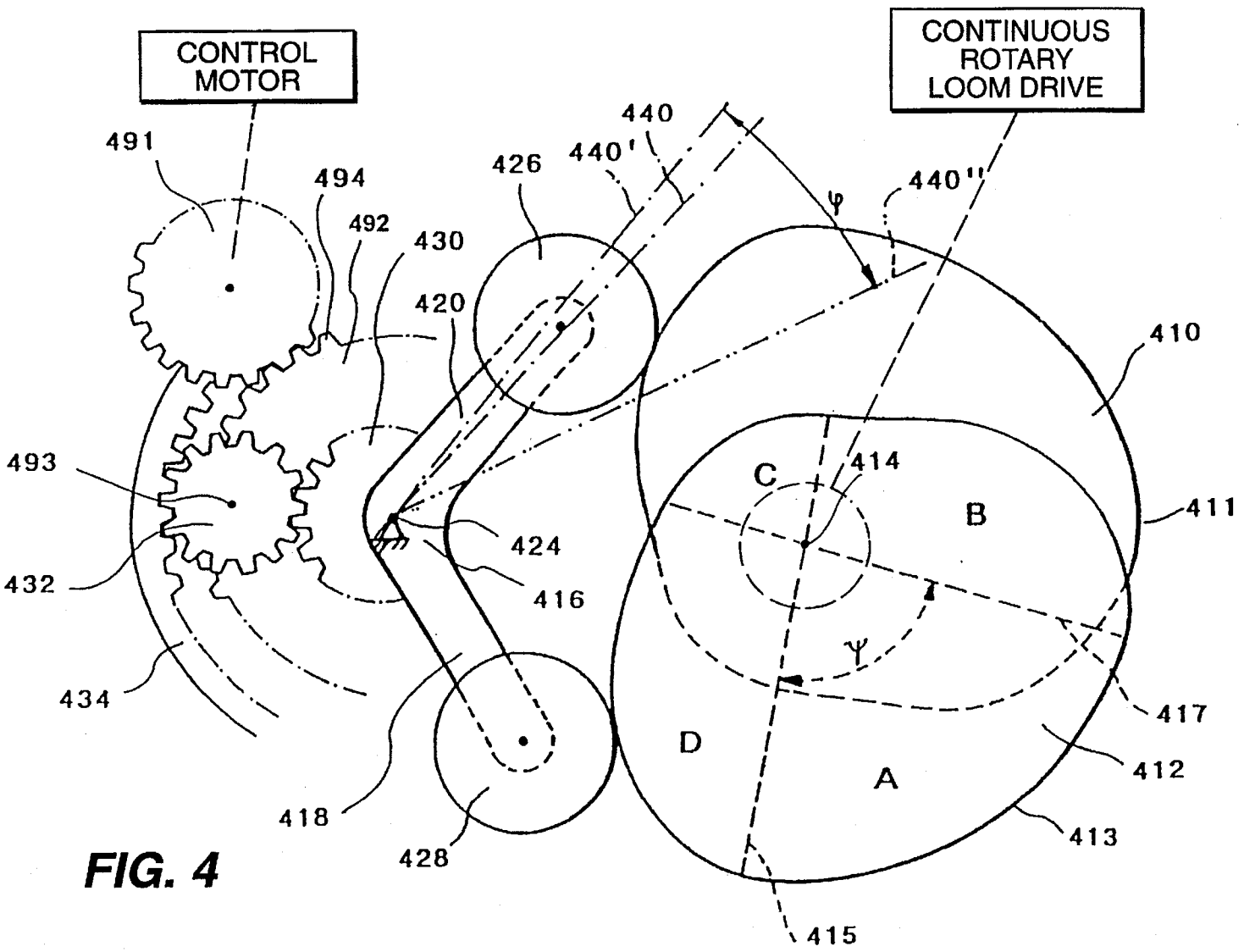
FIG. 4 shows an embodiment of the modulator mechanism according to the present invention provided with an additional rotating device which is independent of the drive means, said embodiment being an alternative to the embodiment according to FIG. 3.

FIG. 4 shows an embodiment of the modulator mechanism which is an alternative to the embodiment according to FIG. 3, said modulator mechanism being provided with an additional rotating device which is independent of the drive means. The parts which are equal or similar to the parts shown in FIG. 1 are again designated by the same reference numerals which have, however, added thereto 400. The embodiment according to FIG. 4 differs from the embodiment according to FIG. 1 with regard to the fact that the planetary gear or the planetary gears 432 are not attached to the lever 416, but that they are rotatably attached to a holder 492 which is adapted to be rotated about an axle 424 extending through the center of rotation of the sun gear 430. In the case of this embodiment, the lever 416 is fixedly connected to the internal gear 434, and, consequently, said internal gear 434 can, in turn, be rotated about said axle 424 together with said lever 416. The planetary gear 432 is arranged such that it is adapted to be rotated about a rotating axle 493, which is displaced radially outwards relative to the rotating axle 424 of the rotatable holder 492. The rotatable holder 492 for the planetary gear or the planetary gears 432 is provided with teeth 494 which are in mesh with a gear 491 of said additional rotating device.

As in the case of the embodiment according to FIG. 3, the gear 491 can be replaced by any other means which is suitable for driving the rotatable holder 492 for the planetary gears, such as a chain, belt or rope drive and a belt-wrap transmission, respectively.

A locking device for fixing the rotatable holder 492 for the planetary gears is provided, this corresponding again to the embodiment according to FIG. 3; for the sake of clarity of the drawing, this locking device is, however, not shown in FIG. 4. In the embodiment according to FIG. 4, the locking device can again be provided in the form of a radially displaceable pin, in particular a wedge-shaped pin, which is adapted to be brought into locking engagement with one or several complementary recesses provided in the rotatable holder 492. It is also possible to provide a friction brake in addition to or as an alternative to the locking device in the form of a radially displaceable pin. Furthermore, locking by means of a toothed clutch is possible, like in the embodiment according to FIG. 3.

An electric motor, a hydraulic motor or a pneumatic motor can be provided as a motor for the additional rotating mechanism, said motor being adapted to be controlled by electronic means or by mechanical means independently of the loom.

The embodiment according to FIG. 4 permits shedding by means of the additional rotating device, which is independent of the drive originating from the loom, when the loom is standing still and when the drive means causing a movement of the cam discs 410 and 412 is at a standstill. When the cam discs 410 and 412 are at a standstill, the lever 416 is fixed at its angular position, since the rollers 426 and 428 abut on the cams 411 and 413 of the cam discs 410 and 412 in an essentially backlash-free manner. The internal gear 434, which is connected to the lever 416, is fixed together with said lever. When the holder 492 has been released, the gear 491 is caused to rotate in response to actuation of the motor of said additional rotating device, said gear 491 enaging the teeth 494, whereby the rotatable holder 492 for the planetary gear 432 will be rotated. When said rotatable holder 492 is rotated, the planetary gear 432 will roll on the internal gear 434, said internal gear 434 being stationary because the drive means is standing still. The rotary movement caused by the rolling movement of the planetary gear 432 is transmitted to the sun gear 430, which is connected to the main shaft. As has already been described with regard to FIG. 2, the heald frame can again be controlled via the main shaft.

By means of the locking device, which is not shown in FIG. 4, the rotatable holder 492 for the planetary gear 432 can be fixed when the loom is in operation, said operation of the loom causing a rotation of the drive means and, consequently, a rotation of the cam discs 410 and 412. If necessary, the locking device can, however, also be released when the loom is in operation. By means of the additional rotating device, a rotary movement can be applied to the sun gear 430 in addition to the rotation caused by the pivoting movement of the lever 416, said rotary movement being applied for achieving e.g. a further extension of the dead center position.

I claim:

1. A modulator mechanism for a rotary dobby, the mechanism having an input for connection with a continuous rotary loom drive, and an output for connection with a main shaft for controlling movement of heald frames in the dobby between extreme stroke positions, so that continuous rotary movement of the loom drive is modulated to control the movement of the heald frames by the main shaft, the mechanism further comprising:

at least one rotatable curved body means drivable by the continuous rotary drive, the curved body means having a curve-shaped surface;

at least one follower means modulated by the curved body means and including a pivoted lever driven though an oscillating pivotal movement upon the follower means being modulated in accordance with the curve-shaped surface of the curve body means;

transmission means coupled to the lever for converting the pivotal movement of the lever into an oscillating rotary movement of the main shaft of the rotary dobby; and a crankshaft drive for connecting the main shaft of the rotary dobby and the heald frames, the oscillating pivotal movement of the pivoted lever by the curve-shaped surface of the curved body means, the transmission means, and the crankshaft drive combining to cause movement of the heald frames by the main shaft that is delayed in the extreme stroke positions of the heald frames.

2. A modulator mechanism according to claim 1, wherein the curved body means comprises a pair of rigidly connected, complementary cam discs, and the lever includes two legs, each of the legs following a respective one of the two cam discs for positively guiding the lever through the oscillating pivotal movement.

3. A modulator mechanism according to one of claims 1 or 2 wherein the follower means includes at least one roller on the lever to engage the curved body means.

4. A modulator mechanism according to one of the claims 1 or 2 wherein the transmission means includes a gear unit having a predetermined transmission ratio for transmitting the oscillating pivotal movement of the lever to the main shaft.

5. A modulator mechanism according to claim 4, wherein the gear unit comprises planetary gearing having a sun gear, an internal ring gear, and at least one planet gear in engagement between the sun gear and the internal ring gear, and wherein the center of the lever pivotal movement lies on the axis of the sun gear and at least one of the sun and the planet gear is rotatably secured to the lever.

6. A modulator mechanism for a rotary dobby, the mechanism having an input for connection with a continuous rotary loom drive, and an output for connection with a main shaft for controlling movement of heald frames in the dobby between extreme stroke positions, so that continuous rotary movement of the loom drive is modulated in a manner that the movement of the heald frames by the main shaft is delayed in the extreme stroke positions, the mechanism further comprising:

at least one rotatable curved body means drivable by the continuous rotary drive, the curved body means having a curve-shaped surface;

at least one follower means modulated by the curved body means and including a pivoted lever driven though an oscillating pivotal movement upon the follower means being modulated in accordance with the curve-shaped surface of the curve body means; and transmission means coupled to the lever for converting the pivotal movement of the lever into an oscillating rotary movement of the main shaft of the rotary dobby, the transmission means including a gear unit having a predetermined transmission ratio for transmitting the oscillating pivotal movement of the lever to the main shaft, the gear unit including spur gearing for transmitting the modulated oscillating movement of the lever to the main shaft.

7. A modulator mechanism for a rotary dobby, the mechanism having an input for connection with a continuous rotary loom drive, and an output for connection with a main shaft for controlling movement of heald frames in the dobby between extreme stroke positions, so that continuous rotary movement of the loom drive is modulated in a manner that the movement of the heald frames by the main shaft is delayed in the extreme stroke positions, the mechanism further comprising:

at least one rotatable curved body means drivable by the continuous rotary drive, the curved body means having a curve-shaped surface;

at least one follower means modulated by the curved body means and including a pivoted lever driven though an oscillating pivotal movement upon the follower means being modulated in accordance with the curve-shaped surface of the curve body means; and transmission means coupled to the lever for converting the pivotal movement of the lever into an oscillating rotary movement of the main shaft of the rotary dobby, the transmission means including a gear unit having a predetermined transmission ratio for transmitting the oscillating pivotal movement of the lever to the main shaft, the gear unit having a transmission ratio causing oscillation of the main shaft through a rotary angle of approximately 180°.

8. A modulator mechanism for a rotary dobby, the mechanism having an input for connection with a continuous rotary loom drive, and an output for connection with a main shaft for controlling movement of heald frames in the dobby between extreme stroke positions, so that continuous rotary movement of the loom drive is modulated in a manner that the movement of the heald frames by the main shaft is delayed in the extreme stroke positions, the mechanism further comprising:

at least one rotatable curved body means drivable by the continuous rotary drive, the curved body means having a curve-shaped surface;

at least one follower means modulated by the curved body means and including a pivoted lever driven though an oscillating pivotal movement upon the follower means being modulated in accordance with the curve-shaped surface of the curve body means;

transmission means coupled to the lever for converting the pivotal movement of the lever into an oscillating rotary movement of the main shaft of the rotary dobby; and an additional rotating drive device, independent of the continuous rotary loom drive, for rotating the main shaft.

9. A modulator mechanism according to claim 8, wherein the transmission means includes planetary gearing for transmitting the oscillating pivotal movement of the lever to the main shaft, said planetary gearing comprising a sun gear connected to the main shaft, and at least one planetary gear engageable between the sun gear and an internal gear, the at least one planetary gear being rotatably secured to said lever, and said internal gear being rotatably supported and adapted to be driven by said additional rotating device.

10. A modulator mechanism according to claim 9, including a locking device to fix the internal gear.

11. A modulator mechanism according to claim 10, wherein the locking device comprises a pin or a wedge displaceable in a radial or axial direction and adapted to be brought into locking engagement with one or more recesses formed in said internal gear.

12. A modulator mechanism according to claim 8, wherein the transmission means includes planetary gearing for transmitting the oscillating pivotal movement of the lever to the main shaft, said planetary gearing comprising a sun gear connected to the main shaft, and at least one planetary gear engageable between the sun gear and an internal gear rigidly connected to said lever, said planetary gear being rotatably secured to a rotatable holder drivable by said additional rotating device.

* * * * *